US005339662A

United States Patent [19]

Goldman

[11] Patent Number: 5,339,662

[45] Date of Patent: Aug. 23, 1994

[54] DOOR LOCKING SYSTEM

[75] Inventor: Ilan Goldman, Herzliya, Israel

[73] Assignee: Ilco Unican, Inc., Montreal, Canada

[21] Appl. No.: 951,785

[22] Filed: Sep. 28, 1992

[30] Foreign Application Priority Data

Oct. 11, 1991 [IL] Israel ..... 099716

[51] Int. Cl.[5] ..... E05B 49/00

[52] U.S. Cl. ..... 70/278; 70/432

[58] Field of Search ..... 70/276–279, 70/432, 434; 292/144

[56] References Cited

U.S. PATENT DOCUMENTS

| | | | |
|---|---|---|---|
| 3,151,698 | 10/1964 | Pollack | 70/280 X |
| 3,513,357 | 5/1970 | Dittmore | 70/278 X |
| 3,828,340 | 8/1974 | Bauer, Jr. et al. | 70/278 X |
| 3,885,408 | 5/1975 | Clark, Jr. | 70/278 |
| 3,926,460 | 12/1975 | Peterson | 292/144 |
| 4,634,155 | 1/1987 | Geringer et al. | 70/432 X |
| 4,649,833 | 3/1987 | Cummins | 70/278 X |
| 4,656,850 | 4/1987 | Tabata | 70/276 |
| 4,744,021 | 5/1988 | Kristy | 70/278 X |
| 4,755,799 | 7/1988 | Romano | 70/278 X |
| 4,789,859 | 12/1988 | Clarkson et al. | 70/278 X |
| 4,827,744 | 5/1989 | Namazue et al. | 70/277 X |
| 4,845,471 | 7/1989 | Chu | 70/432 X |
| 4,848,115 | 7/1989 | Clarkson et al. | 70/276 |
| 4,907,429 | 3/1990 | Davis et al. | 70/279 |
| 4,917,022 | 4/1990 | Ogasawara et al. | 70/278 X |
| 4,929,005 | 5/1990 | Heinen | 292/251.5 |
| 4,967,305 | 10/1990 | Murrer et al. | 70/278 X |
| 5,000,018 | 3/1991 | Eisermann | 70/277 |
| 5,020,345 | 6/1991 | Gartner et al. | 70/277 |
| 5,043,593 | 8/1991 | Tsutsumi et al. | 70/278 X |
| 5,062,670 | 11/1991 | Grossman | 292/137 |
| 5,076,623 | 12/1991 | Richards | 292/251 |
| 5,164,718 | 11/1992 | Cedergren | 70/278 X |

FOREIGN PATENT DOCUMENTS

| | | | |
|---|---|---|---|
| 1022652 | 12/1977 | Canada . | |
| 0197893 | 10/1986 | European Pat. Off. . | |
| 290010 | 11/1988 | European Pat. Off. | 70/278 |
| 3520397 | 12/1986 | Fed. Rep. of Germany | 70/278 |
| 8710404 | 12/1987 | Fed. Rep. of Germany . | |
| 3904215 | 8/1989 | Fed. Rep. of Germany . | |
| 2571773 | 4/1986 | France | 70/432 |
| 110098 | 8/1979 | Japan | 70/278 |
| 229372 | 9/1990 | Japan | 70/278 |
| 2111580 | 7/1983 | United Kingdom | 70/278 |
| 2202577 | 9/1988 | United Kingdom . | |

OTHER PUBLICATIONS

Hermann, "The SmartGard: computerized access control for safes", Locksmith Ledger International, May 1989, pp. 19–26.

*Primary Examiner*—Peter M. Cuomo
*Assistant Examiner*—Suzanne L. Dino
*Attorney, Agent, or Firm*—Hill, Steadman & Simpson

[57] ABSTRACT

A locking system is provided for doors with a bolt unit installed on the inside and a control unit installed on the outside of the door. The bolt unit has a casing enclosing a bolt displaceable between a projected, locking position and a withdrawn, unlocking position. A solenoid device has an armature being displaceable between electromagnetically induced attracted and repelled positions. Linkage means are coupled between the armature and the bolt to drive the bolt between the unlocking and locking positions, respectively. A pass code may be entered into the control unit, and in response, a solenoid may be actuated by a current pulse into the unlocked position of the bolt. In addition, a reverse current pulse actuates the solenoid into a locked position of the bolt.

24 Claims, 9 Drawing Sheets

FIG. 1A
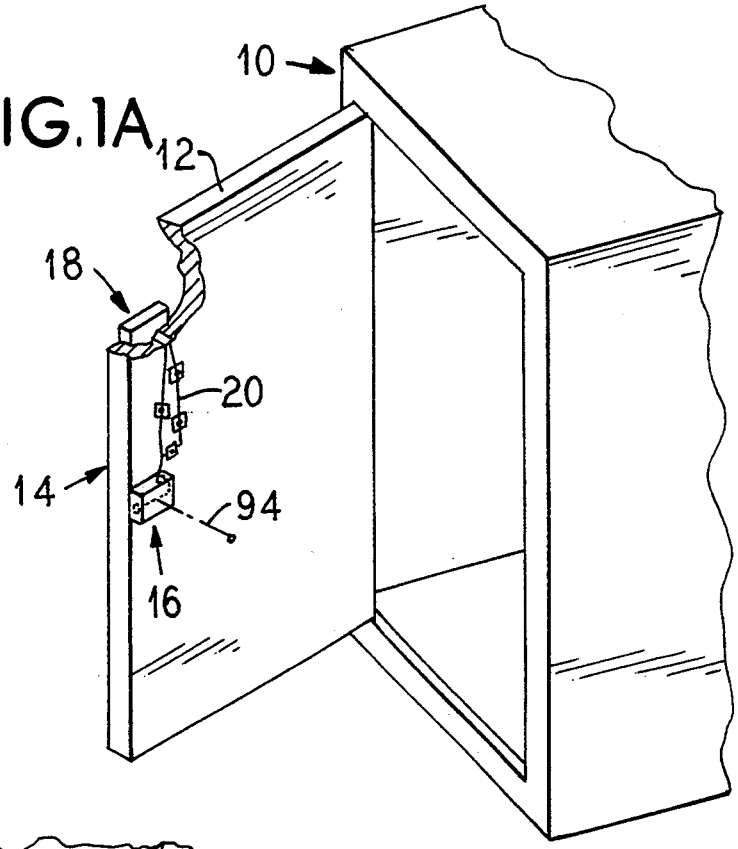
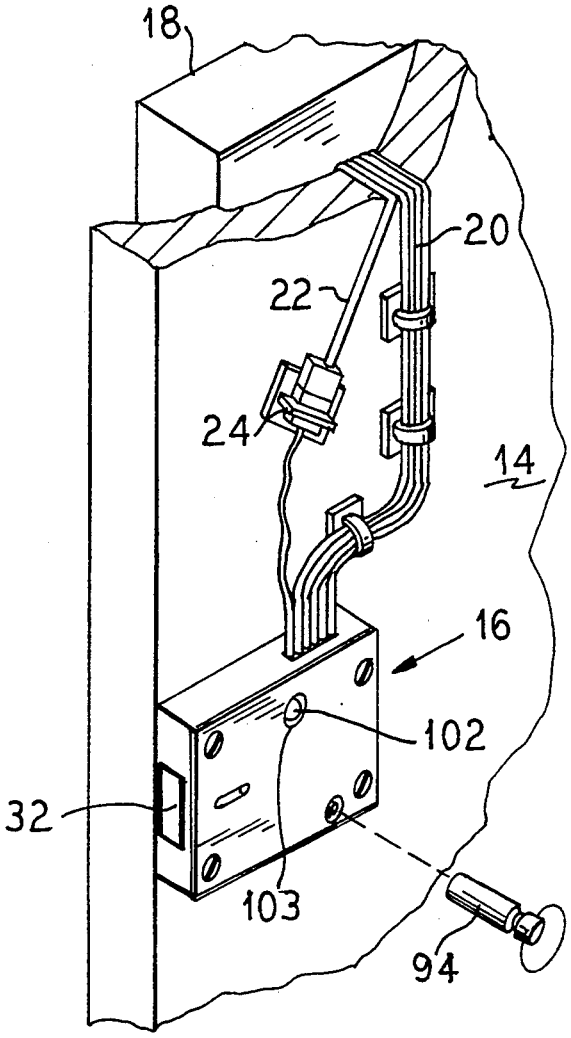
FIG. 2A

FIG. 1B
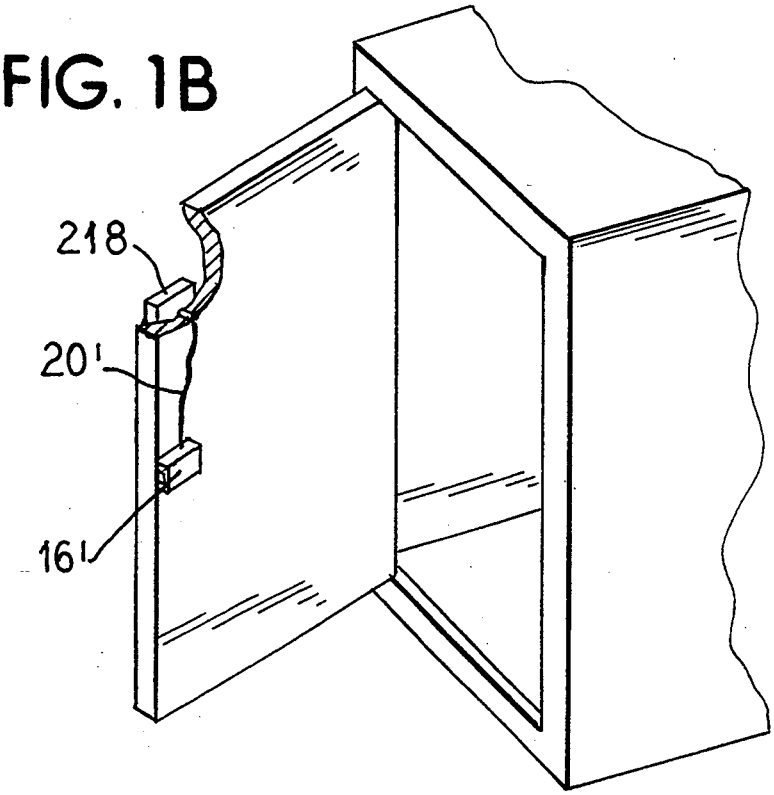
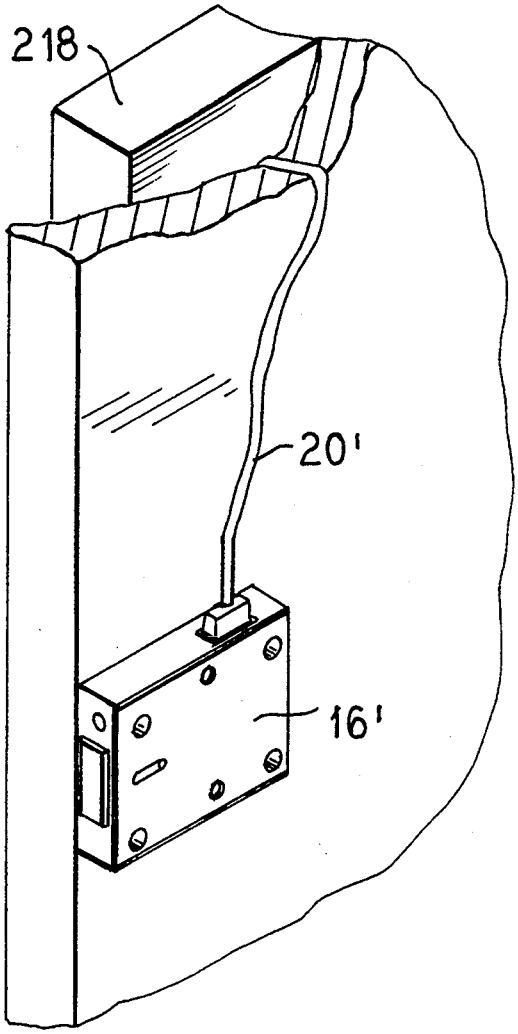
FIG. 2B 18
12
42
lock
40
38
36
30
01
32
02
03
34
28

DOOR LOCKING SYSTEM

BACKGROUND OF THE INVENTION

The present invention relates to a locking system for doors, more particularly to electromagnetically operated locks.

Locks and locking systems are very common devices, varying in complexity from the simple bolt to extremely complicated multi-faceted barrel, cylinder and mortise locks, operable by any number of different means including keys, push-buttons and electronically protected passwords. All locks are provided for the same primary purpose, namely, to protect a defined space whether it might be a vault, on the one hand, or the interior of a room or apartment on the other hand.

One of the common types of locking systems comprises a solenoid in conjunction with a mortise-type lock. When used in connection with a magnetic card or keyed-in password or code for operating the lock, such systems offer a relatively high level of security. Known in the art, solenoid operated locks require a continuous electric supply to maintain the solenoid in an active—usually unlocking—state. Such locks are, therefore, characterized by a high energy consumption ruling out the use of batteries as an alternative to mains electricity supply since the batteries are liable to discharge rather rapidly.

It is, however, desirable to use self-contained power units in the form of dry or other types of batteries, thus saving the need for wiring the lock system to the mains, transforming and rectifying the current, etc.

SUMMARY OF THE INVENTION

It is, therefore, an object of the present invention to provide a battery-operated, low-energy consumption, locking system which overcomes the above-listed and other deficiencies of the conventional systems.

According to the invention, there is provided a locking system for doors consisting of a bolt unit installed on the inside and a control unit installed on the outside of the door. The bolt unit comprises a casing enclosing a bolt displaceable between a projected locking position and a withdrawn, unlocking position. A solenoid device has an armature which is displaceable between the electromagnetically induced attracted and repelled positions. Linkage means are coupled between the armature and the bolt to drive the bolt between the unlocking and locking positions, respectively. A control unit comprises an electric power source, means for entering a pass-code, means responsive to entering of the pass-code to actuate the solenoid by a current pulse into the unlocked position of the bolt, and means for actuating the solenoid by a reverse current pulse into the locking position of the bolt.

The solenoid device preferably comprises restraining means for impeding the movement of the armature when in the attracted position in the form of a permanent magnet encompassing the armature.

The linkage means may comprise a lever arm pivoted at one end thereof to the bolt unit casing, at the other end thereof to the bolt, and at a mid-point thereof to the armature. The linkage means may be formed with a pair of slots constructionally associated with the mid-point and the other end pivotally connected so that the bolt becomes arrested in its locked position against externally forced displacement thereof in the unlocking direction, e.g. during an attempted burglary.

Additional features and advantages of the present invention are described, and will be apparent from, the detailed description of the presently preferred embodiments and from the drawings.

BRIEF DESCRIPTION OF THE DRAWINGS

FIG. 1A is an internal perspective view of a vault or safe door fitted with a locking system provided according to a preferred embodiment of the present invention.

FIG. 1B is an internal perspective view of another embodiment of a vault or safe door using a four-cable connector.

FIG. 2A is an enlarged fragmentary view of the locking system of FIG. 1A.

FIG. 2B is an enlarged fragmentary view of the locking system of FIG. 1B.

DETAILED DESCRIPTION OF THE PREFERRED EMBODIMENTS

Figure 3:
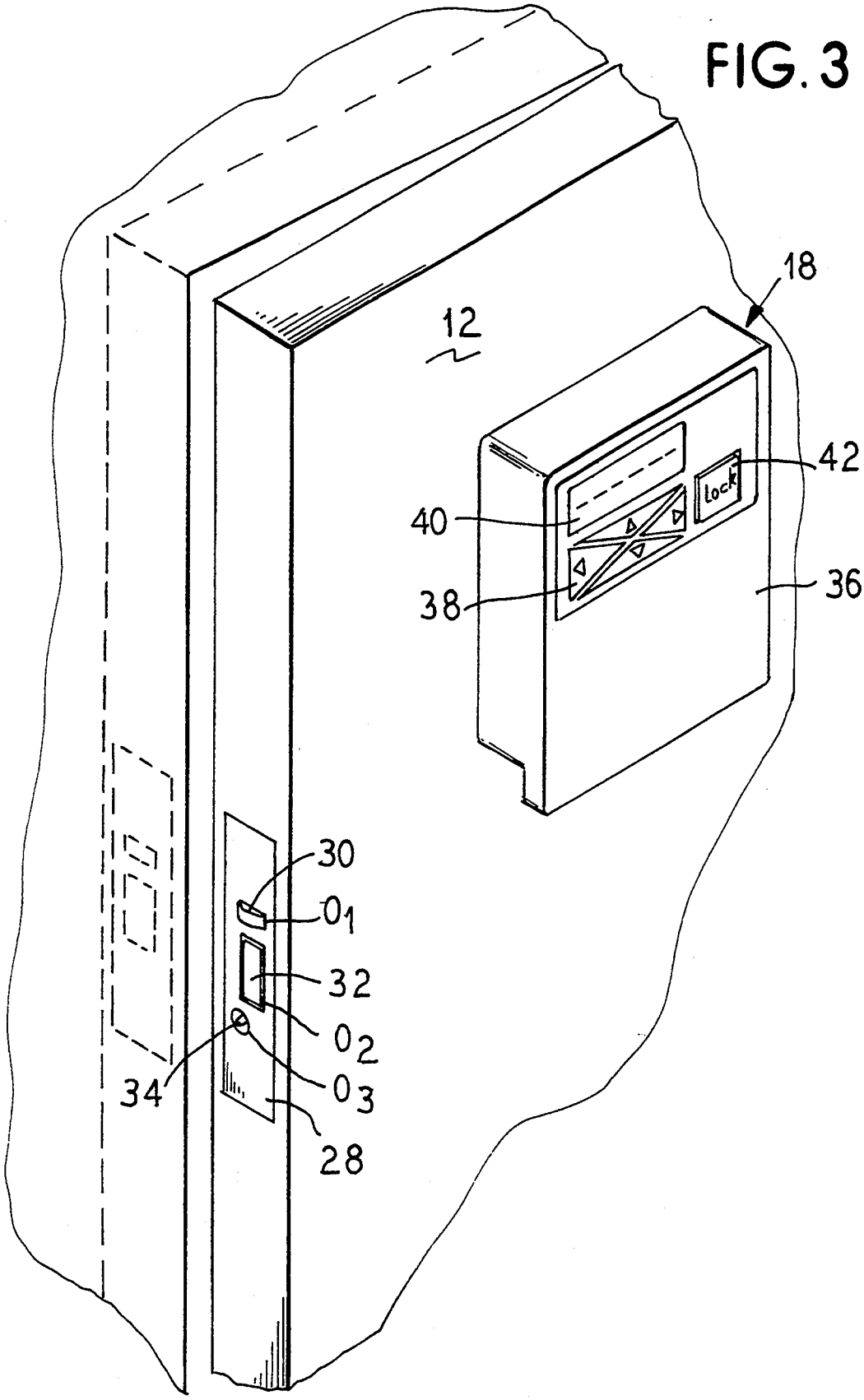
FIG. 3 is a perspective view of the mounting of the control unit on the door of FIG. 1A.

Referring to FIGS. 1A and 2A, there is partly shown a safe, denoted at 10, having a door 12 shown in an open position. As will be readily understood from the following description, the door 12 may be of various types such as for a safe or other enclosed compartment 1 or of an apartment or any other more open structures such as shown at 12*a*.

The door 12 may be fitted with a locking system generally denoted at 14 having an internally fitted bolt unit 16 and an externally fitted control unit 18 connected to the bolt unit 16 by a plait of current carrying wires 20.

At least one wire 22 from the set of current carrying wires 20 is maintained in a state of tension by means of a plug and socket connecting device 24 rigidly attached to the inside of the door 12. Therefore, should an attempt be made to remove or tamper with any part of the control unit 18, cable 22 will disengage from the connecting device 24 thereby disabling the electrical circuit and preventing the operation of the bolt unit 16.

FIGS. 1B and 2B illustrate an alternate embodiment for current carrying wires 20' between bolt operating unit 216 and control unit 218. The current carrying wires 20' are in the form of a four-cable connector. The locking system may, therefore, be easily installed by screw-mounting each of the units 216 and 218, then plugging the connector wires 20' into the bolt operating unit 216. The connector wires 20' connect the units 216 and 218 for both power and communication therebetween.

Referring now to FIG. 3, the jamb of the door 26 is fitted with a jamb plate 28 having a first punched out opening $O_1$ for the spring-loaded door centering detent 30, a second opening $0_2$ for the movement of bolt-unit lock tongue 32, and a third opening $O_3$ for the exposure of an optical sensor 34, the purpose of which will be explained further below.

The housing panel 36 of the control unit 18 is provided with a four-key scrolling keyboard 38 for entering a predetermined pass-code which is then digitally displayed on a screen 40 above the keyboard 38, as can be better seen with reference to FIG. 4. The four keys indicate up, down, left and right. The left and right keys are used for positioning the cursor, and the up and down keys are used for scrolling through the numerals 0 to 9.

The pass-code may be entered as follows:

1. Commencing with the position to the furthest left, a number from 0 to 9 is entered by scrolling up or down until the required numeral appears on the display 40.
2. The right key is pressed once.
3. A number is entered as described in step 1 above.
4. Steps 2 and 3 are repeated until all of the numbers of the pass-code have been entered. The left and right keys are also to move across the display in order to alter or correct any number.

The completion of the correct pass-code entering will automatically operate the look unit 16 to unlock the door. Pressing on "LOCK" button 42 when the door is closed, as detected by the optical sensor 34 will result in the locking of the door by the lock unit 16.

Figure 4A:
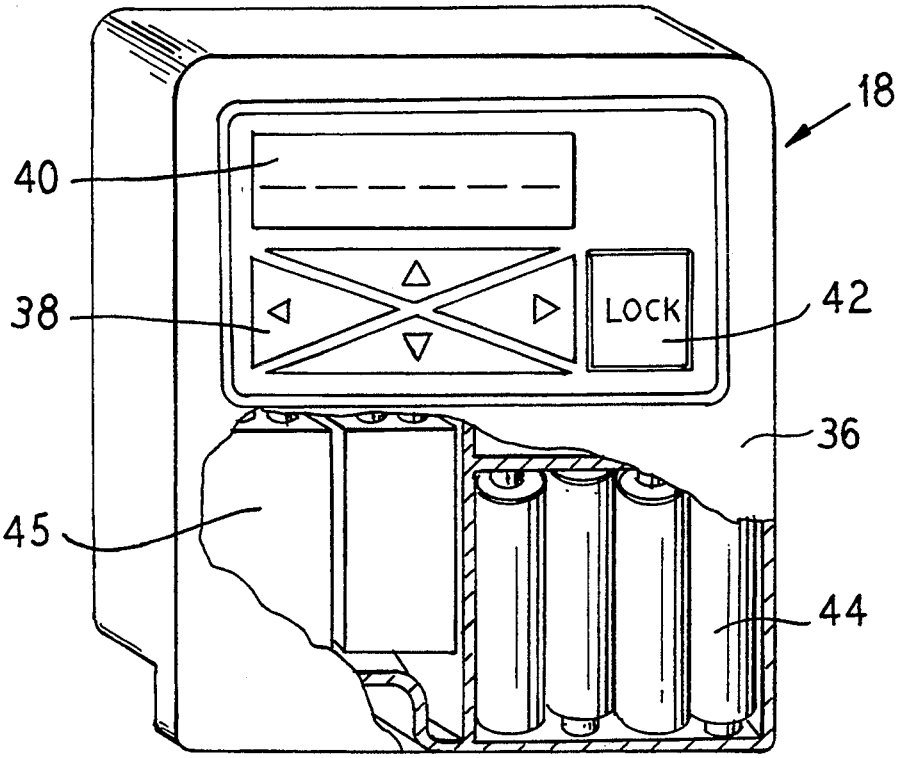
FIGS. 4A and 4B illustrate perspective views of a first embodiment and second embodiment, respectively, of the control unit as shown in FIG. 3 having a scrolling keyboard.

FIG. 4A shows the control unit 18 in enlarged detail, cut away to display a set of dry-cell batteries 44 which act as the power source for the operation of the bolt unit 16 and memory units 45.

Figure 4B:
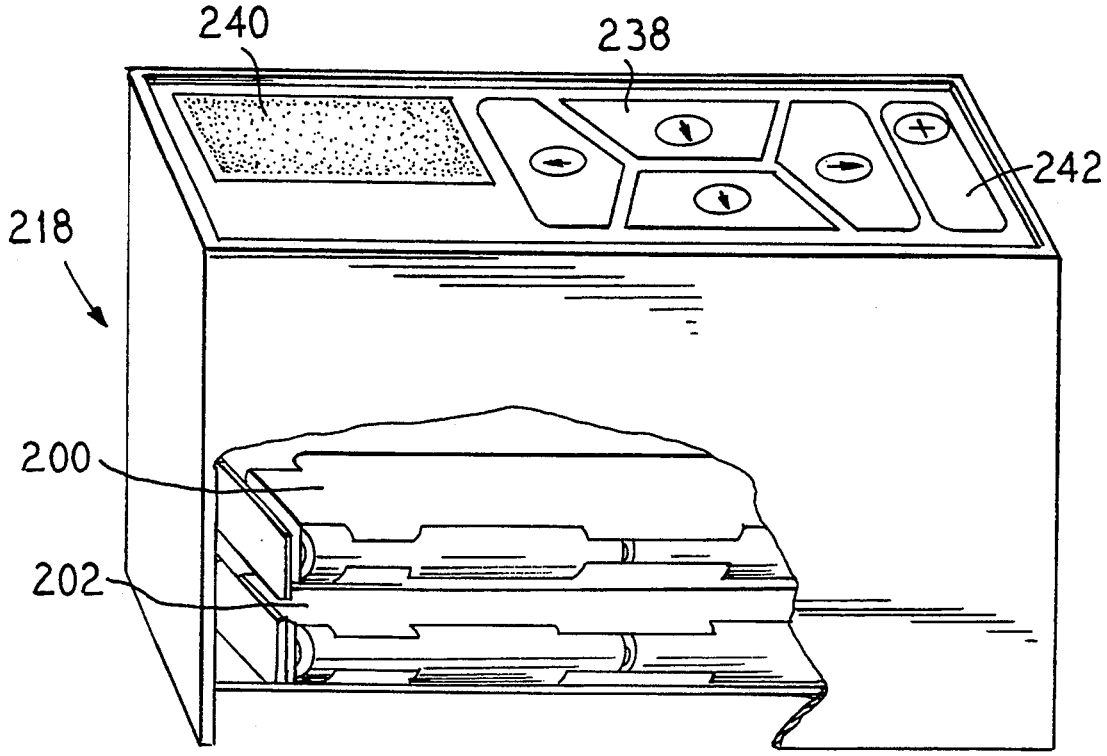

FIG. 4B shows a control unit 218 similar to that of FIG. 4A. The control unit 218 is designed for top reading of a display 240. Cursors 238 operate in the same manner as described with reference to FIG. 4A as well as the "LOCK" button 242. The control unit 218 includes an electronic control system 200 seated on top of a set of batteries 202. The control system 200 will be described with reference to FIG. 13.

The scrolling-type operator shown in FIGS. 4A and 4B has the advantage in that fingerprint marks left on the more frequently used keys cannot assist an intruder in identifying or tracing the secret code, in contrast to a digital keyboard.

Figure 5A:
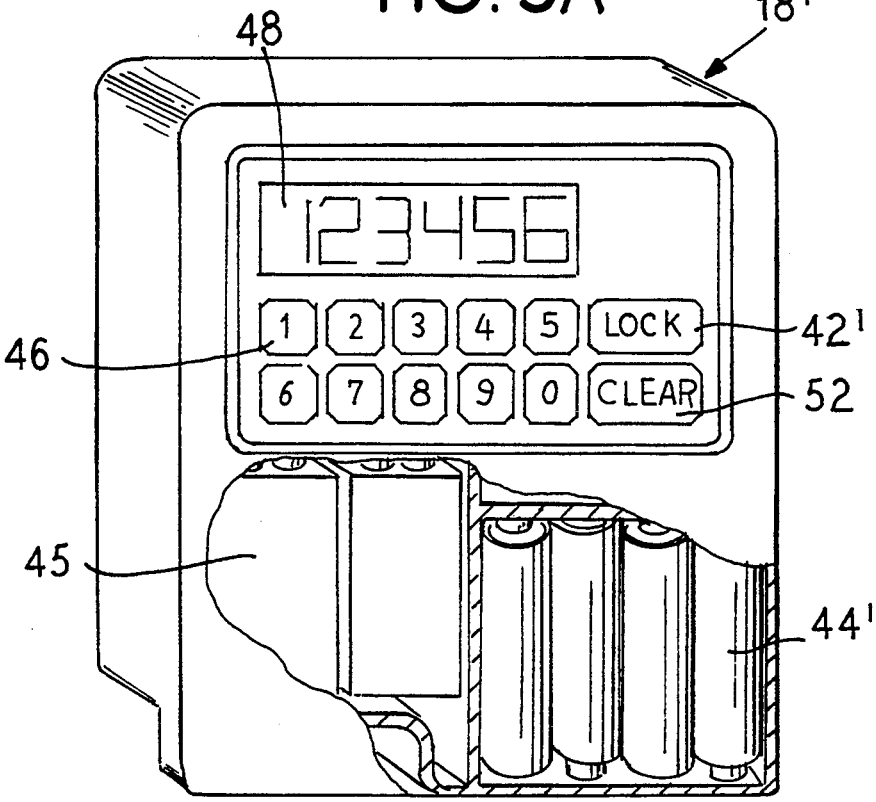
FIGS. 5A and 5B illustrate perspective views of a third embodiment and a fourth embodiment, respectively, of the control unit of FIG. 3 having a numerical keyboard.

In an alternative embodiment shown in FIG. 5A, the control unit 18' has a numeric keyboard 46, together with a digital display 48, showing the numerals 1, 2, 3, 4, 5 and 6, by way of example. Button 42' operates to lock the system. The "CLEAR" push button 52 is functional in correcting mistaken entries into the keyboard.

Figure 5B:
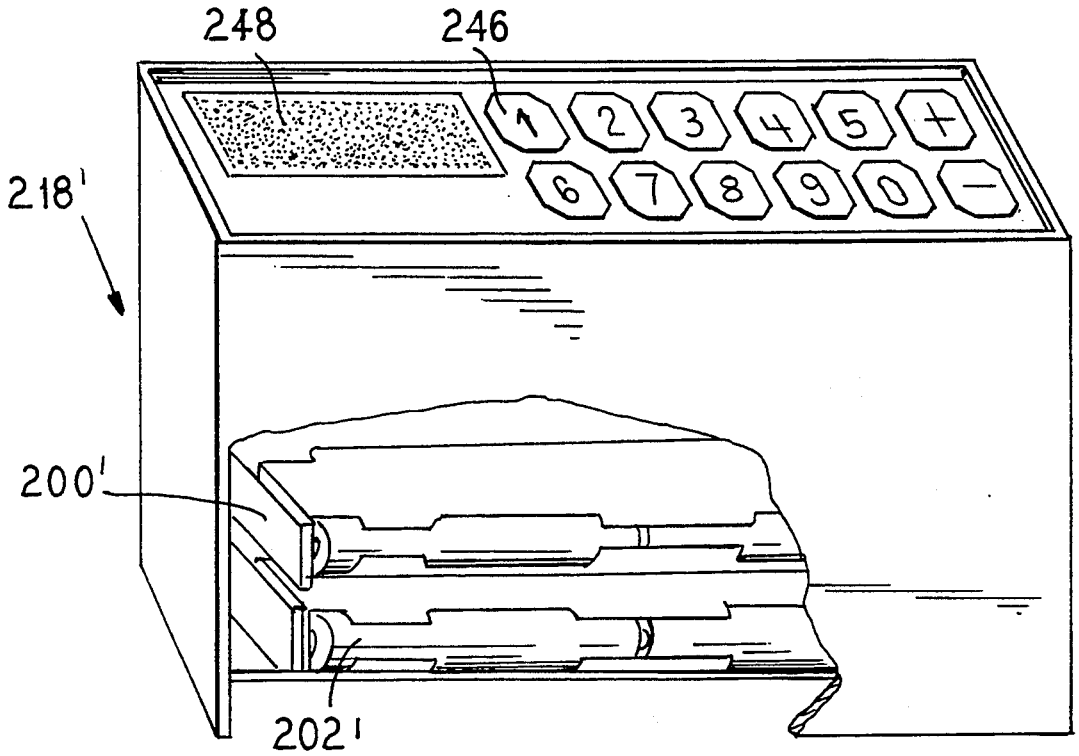

FIG. 5B shows the control unit 218' having a numeric keyboard 246 together with a digital display 248 designed on a top panel for the control unit 218 for top reading of the display 248. A control system 200' may be seated on top of a set of batteries 202' as described with reference to FIG. 4B. The control system 200' will be further described with reference to FIG. 13.

Figures 6, 7:
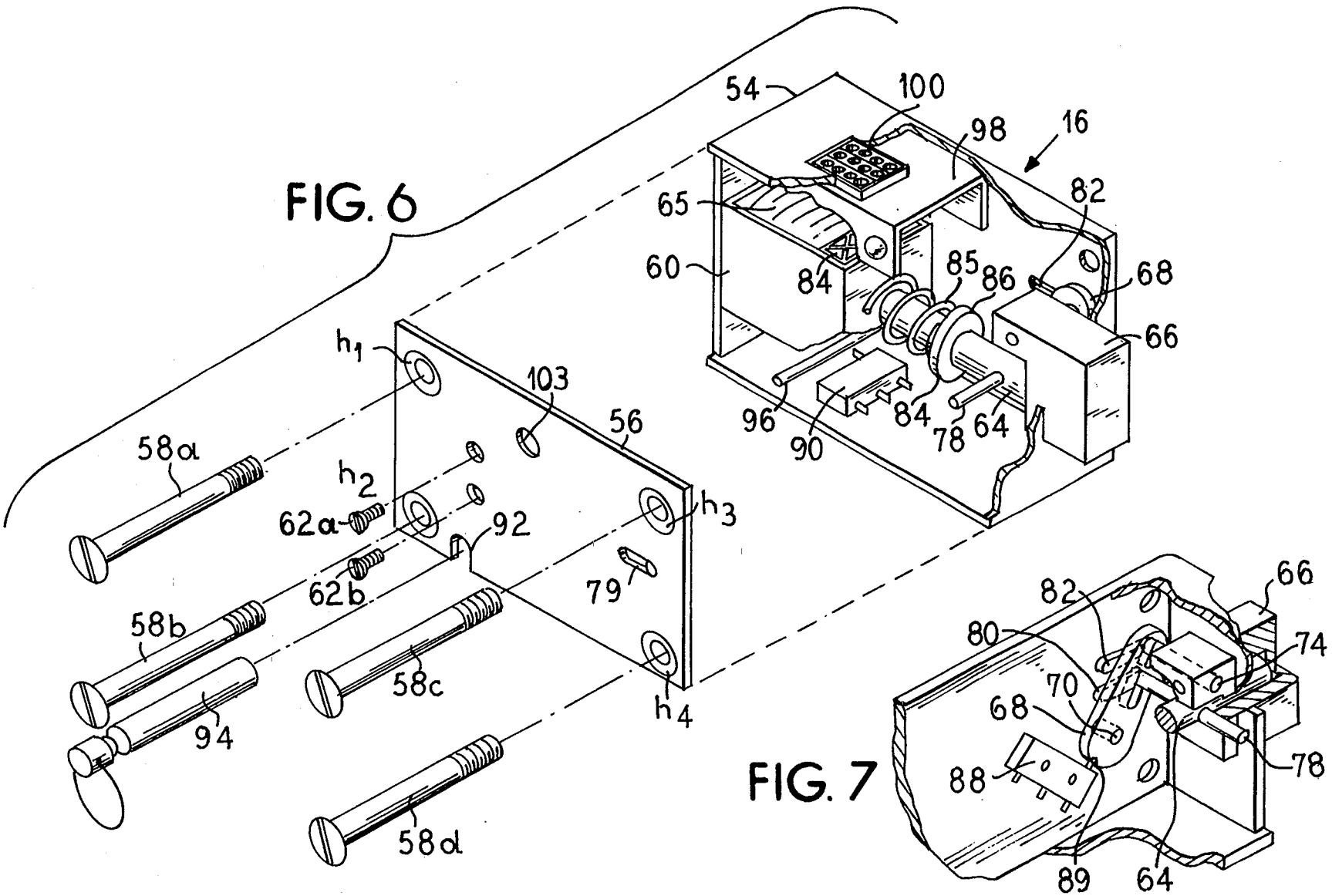
FIG. 6 is an exploded, cut-away, perspective view of the internal locking unit mechanism.
FIG. 7 is a further detailed perspective view of the locking mechanism of FIG. 6.

Referring now to FIG. 6, the bolt unit 16 comprises a casing 54 having a removable cover plate 56 on one side. The bolt unit 16 is rigidly attached at each corner to the inside of the door 12 by means of four, flat-headed, bevelled, screw bolts 58*a*, 58*b*, 58*c* and 58*d* passing through four recessed holes denoted $h_1$, $h_2$, $h_3$ and $h_4$, respectively. The cover plate 56 may then be attached to the body of a solenoid device 60 by means of two screws 62*a* and 62*b*.

The casing 54 encloses the solenoid device 60 having an iron-core or armature 64 displaceable between electromagnetically induced attracted or repelled positions depending on the direction of the current passed through its coil 65. The armature 64 is coupled to lock a bolt or tongue 66 of the bolt unit 16 by means of a lever arm 68 (see FIG. 7).

Figure 8A:
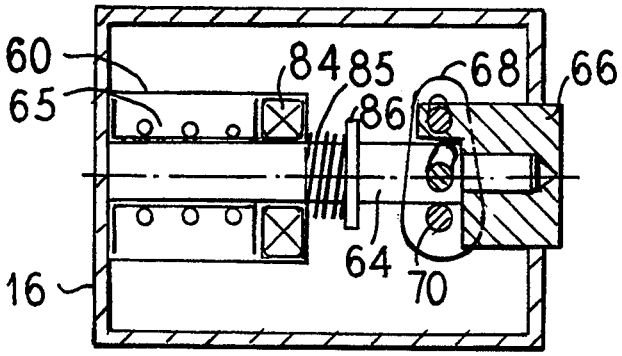
FIG. 8A is a schematic sectional view of the bolt unit operating components in an unlocked position.

The lever arm 68 may be pivoted at one end using a first pivot pin 70 to the bolt unit casing 54. The lever arm 68 may be pivoted at the other end to the bolt 66 by a second pivot pin 74, and at its midpoint the lever arm 68 may be pivoted to the armature 64 by a third pivot and guide pin 78 (see FIGS. 8A, 9A and 10A).

The pin 78 acts both as a pivotal coupling to the armature 64 and as a guide for its linear movement by being supported within opposite slots 79 and 80 (see FIG. 7) formed in the housing wall 54. The pin 78 also passes through a "V"-shaped slot 81 formed in the arm 68.

Referring to FIG. 7, the pin 74 passes through a slot 82 at the housing wall 54 and through an elongated guide slot 83 in the lever arm 68. The combination of slots allows for the angular movement of the arm 68 about the pivot 70 whereas leg or branch 81*a* of slot 81 in combination with the slot 83 serves the function of self-locking the bolt 66 in the manner to be hereinafter described.

The solenoid device 60 with the coil 65 comprises, in addition, a permanent magnet 84 which may be formed of two half-ring sections configured to normally attract the armature 64 and restrain its displacement by a force which is related to the location thereof as will be explained below. A coil compression spring 85 is provided between a collar 86 on armature 64 in the respective solenoid device 60 tending to drive the armature 64 in the locking direction of the bolt 66.

A microswitch 88 is mounted onto the inner wall of the casing 54 juxtaposed with one end 89 of the lever arm 68 so as to indicate the status of the bolt unit 16, that is, whether it is in the locked or unlocked position.

A second microswitch 90 is fitted to the wall of the casing 54 accessible through a keyhole 92 by a resetting key 94 to be inserted and guided by a matching male-oriented cylindrical pin 96 in juxtaposition with the microswitch 90. This is used when the need arises to reset the old pass code and enter a new pass code.

The casing 54 is strengthened by a "U"-shaped channel 98 and is provided with a multi-cavity socket 100 for the current carrying wires 22 shown in FIG. 2 electrically connecting the bolt unit 16 to the control unit 18.

Alternatively, to the embodiment shown in FIG. 3, where the optical sensor 34 has been mounted to the jamb of the door 12, an optical sensor 102 is shown exposed through a hole 103 and cover plate 56 (see FIG. 2A). The optical sensor 102 or the optical sensor 34 in FIG. 3 is electrically coupled to the system such that the system is enabled to permit locking only when the door 12 is closed, that is, in darkness, and is disabled, i.e. incapable of locking, but allows changing of the password when the door 12 is opened.

Figure 8B:
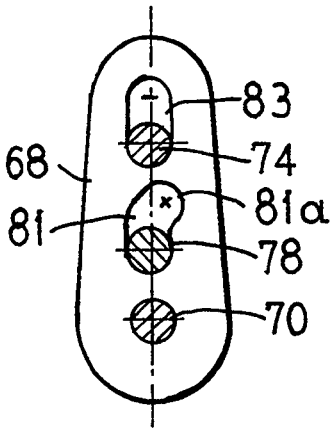
FIG. 8B is an enlarged detailed view of the locking mechanism in the position of FIG. 8A.

The operation of the door locking system is, therefore, as follows:

While door 12 is in an open position, microswitch 90 is reset and a pass-code is entered into the memory of the system. At this stage, current is not being consumed and the bolt 66 is in its withdrawn position (see FIGS. 8A and 8B) being held in place by the magnet 84 against the bias spring 85. This position represents the maximum force applied by the permanent magnet 84.

The door 12 is closed and locked by pressing button 42 (or 42'). Current is momentarily transmitted to the coil 65 causing the armature 64 to be repelled. Since the force of the spring 85 is at a maximum, the combined forces overcome the maximum restraining force of the magnet 84. The initial electromagnetically induced repelling force as well as the force of the magnet 84 decreases as the armature 64 moves away from the inside of the electric coil 83 in proportion to the square of the travel distance of the core.

Figure 9A:
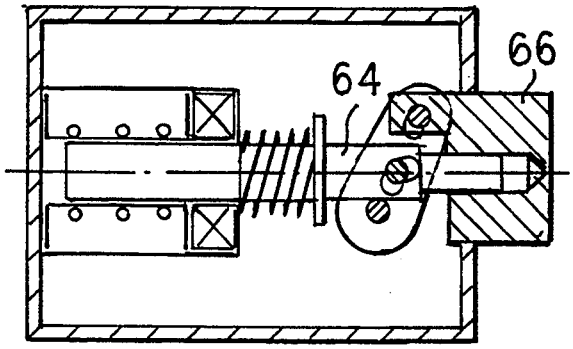
FIG. 9A is a schematic sectional view of the bolt unit in an initial locked position.
Figure 9B:
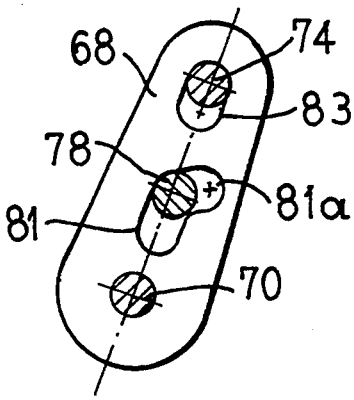
FIG. 9B is an enlarged detailed view of the locking mechanism in the position shown in FIG. 9A.
Figure 10A:
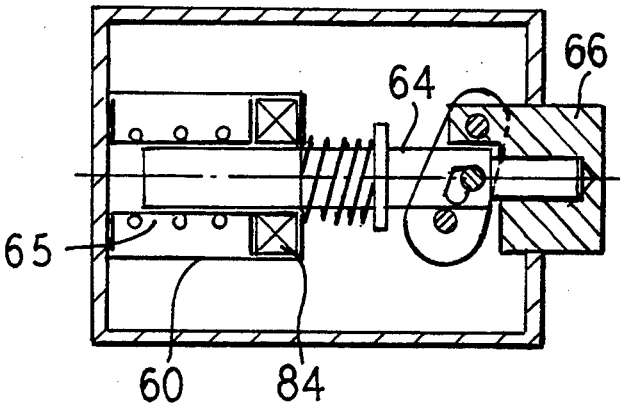
FIG. 10A is a schematic sectional view of the bolt unit in a final locked position.

For this reason, the linkage means, in the form of lever arm 68 is provided. Namely, the travel distance of the bolt is amplified by a factor of two, in the present example. The lever arm 68 reacts to the lateral movement of pin 78 which is attached to armature 64 and by pin 74 attached to bolt 66 forcing the bolt 66 out of the bolt casing 54. The initial locking position is illustrated by FIGS. 9A and 9B. In this position, the pin 74 has been forced to the upper edge of slot 82 to the furthest extent possible, and the pin 78 has been forced upward within its slot 81 to the position shown in FIG. 9B.

Figure 10B:
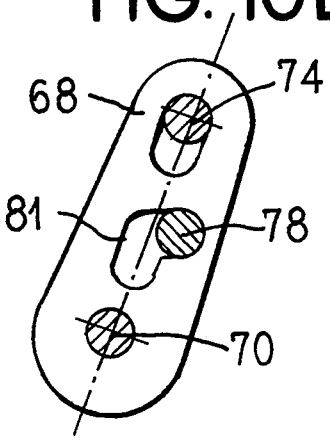
FIG. 10B is an enlarged detailed view of the locking mechanism in the position shown in FIG. 10A.

The current pulse is terminated, and the stroke completed by a further extension of the coil spring 85 against the force of the magnet which is now decreased to a minimum. The pin 78 is then pushed within branch 81*a* of the slot 81 in a lateral direction (see FIG. 10B) thereby locking the bolt 66 in its extended position.

The self-locking feature as illustrated protects the bolt 66 against being forced back by an externally applied mechanical action. The bolt 66, therefore, can only be returned to its unlocked position by first applying a contrary electromagnetic pulse to the system thereby releasing the armature 64.

In order to unlock the door 12, the correct pass code needs to be entered. An opposite current pulse is then transmitted to the solenoid 60 inducing a negative electromagnetic force causing the armature 64 to be retracted and thereby initially compressing the coil spring 85. The pin 78 attached to the armature 64 is released by being pulled back to the position shown in FIGS. 9A and 9B. The electromagnetically induced force increases as the armature 64 nears the inside of the coil 85 in accordance with the parabolic formula as previously described and against the linearly increasing counterforce of the coil spring 85. The forces of both the coil 65 and the magnet 84 increase overcoming together the increasing force of the coil spring 85.

The lever arm 68, therefore, returns to its initial unlocked position as the pin 78 is pulled back with the retracing movement of the armature 64. Pins 74 and 78 drop down within their respective slots 83 and 81 to the position shown in FIGS. 8A and 8B. This position is retained after the current supply to the coil 65 is terminated.

It will be therefore readily understood that the relative forces of the electromagnet 60, the permanent magnet 84 and the coil spring 85 are designed and configured in such a manner as to enable the operation in the above-described fashion.

Figures 11, 12:
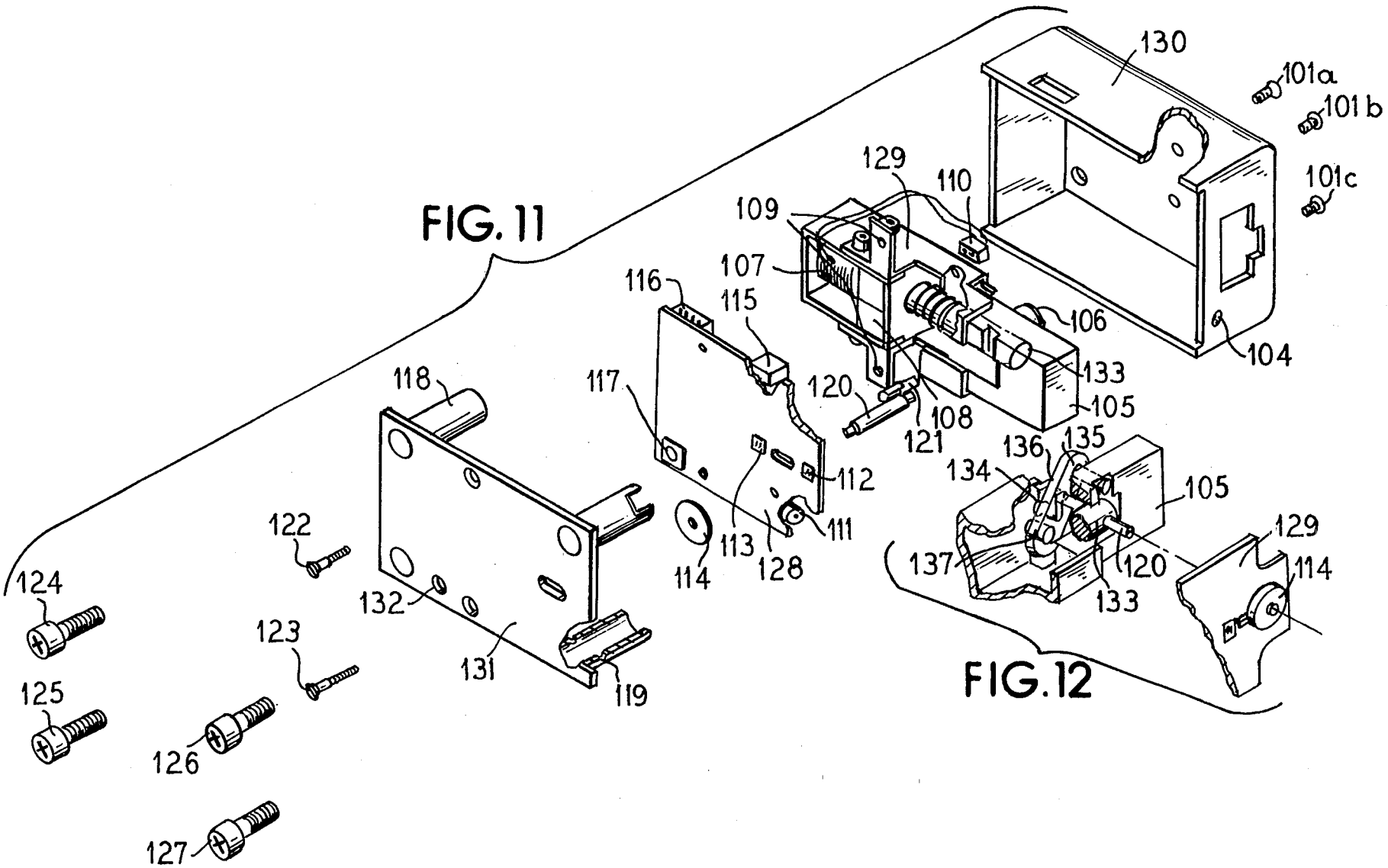
FIG. 11 is an exploded, cut-way, perspective view of another embodiment of the internal locking unit mechanism.
FIG. 12 is a further detailed perspective view of the locking mechanism of FIG. 11.

An alternative embodiment of the present invention is shown in FIGS. 11–14. As illustrated in FIG. 11, as compared to FIG. 6, a solenoid holder 129 may be secured within a lock case 130 by screws 101*a*, 101*b* and 101*c*. The lock case 130 includes an aperture 104 for light to enter for detection by an optical sensor 111 mounted on a printed circuit board 128. The optical sensor 111 is located as shown when mounted on a door jamb. Alternatively, the optical sensor 11 may be located on a tube edge when used on a safe door, cabinet door, or the like. A sticker may cover the aperture 104 or tube edge when not in use.

A first connector 110 from a solenoid coil 107 connects to the printed circuit board 128 at second connector 115. The solenoid holder 129 holding the solenoid coil 107 further includes a bolt 105, rotating plate 106 and magnet 108. Threaded holes 109 receive screws 122 and 123 securing the printed circuit board 128 and a lock cover 131 to the solenoid holder 129.

A solenoid armature 133 moves the bolt 105 between attracted and repelled positions. The solenoid armature 133 includes a pin 120 located therein, and the bolt 105 includes another pin 121 located therein. A washer 114 sits on the pin 120 to thereby move with the solenoid armature 133. As a result, an optical switch 114 detects the position of the washer 114. If the optical switch 112 receives a signal, the bolt 105 is locked. If, on the other hand, a second optical switch 113 receives a signal, the bolt 105 is unlocked.

The printed circuit board 128 further includes a third connector 116 for connecting a cable to the control unit 218. A reset switch 117 is further included for complete system resetting.

The lock cover 131 includes tubes 118 to guide screws 124, 125 and 126 with tube 119 for guide screw 127 including a light entrance from the hole 104 to the optical sensor 111. A further hole 132 in the lock cover 131 provides access to the reset switch 117.

FIG. 12 illustrates a pin 120 passing through the armature 133 and lever arm 135 to a slot 134 in the wall of the solenoid holder 129. The pin 121, as well, passes through the lever arm 135 to a slot 136 in the wall of the holder 129. The combination of slots, like that shown in FIG. 7, allows for angular movement of the arm 135 about a pivot 137. It further allows for geometric locking of the bolt such that it cannot be pushed back.

Figure 13:
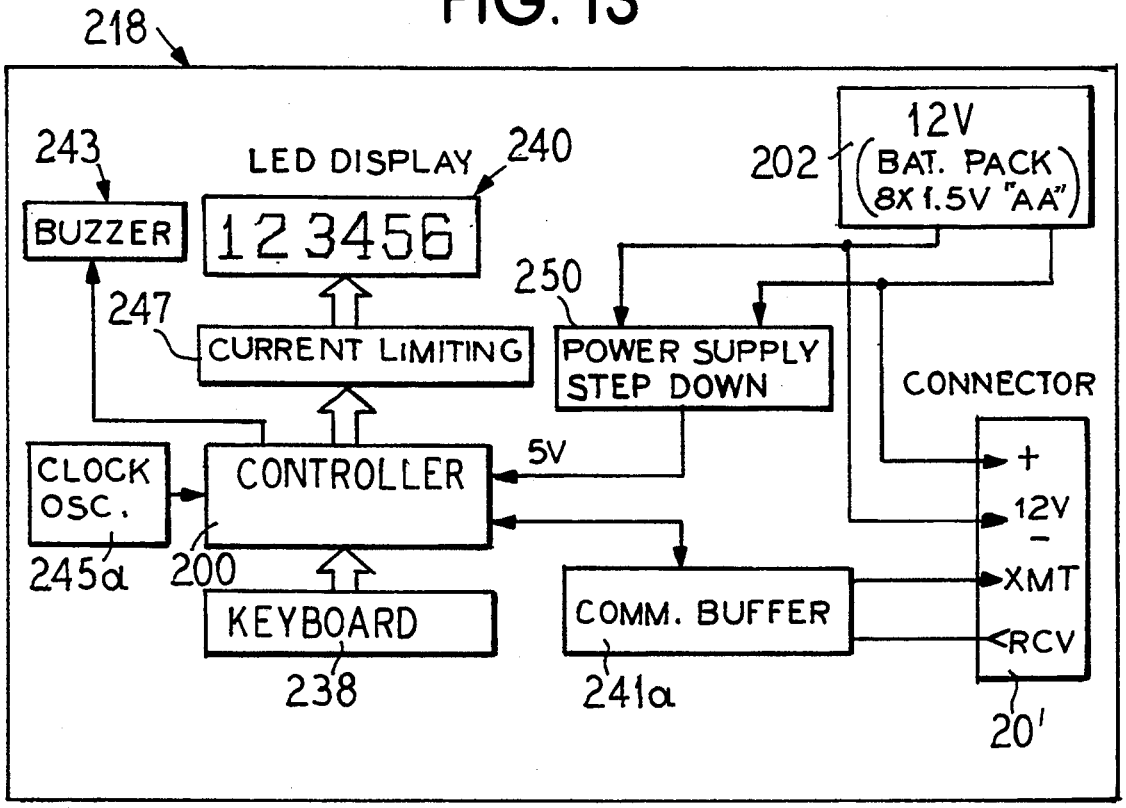
FIG. 13 is a diagram of the circuit components of the control unit for the electronic lock of FIGS. 4B and 5B
Figure 14:
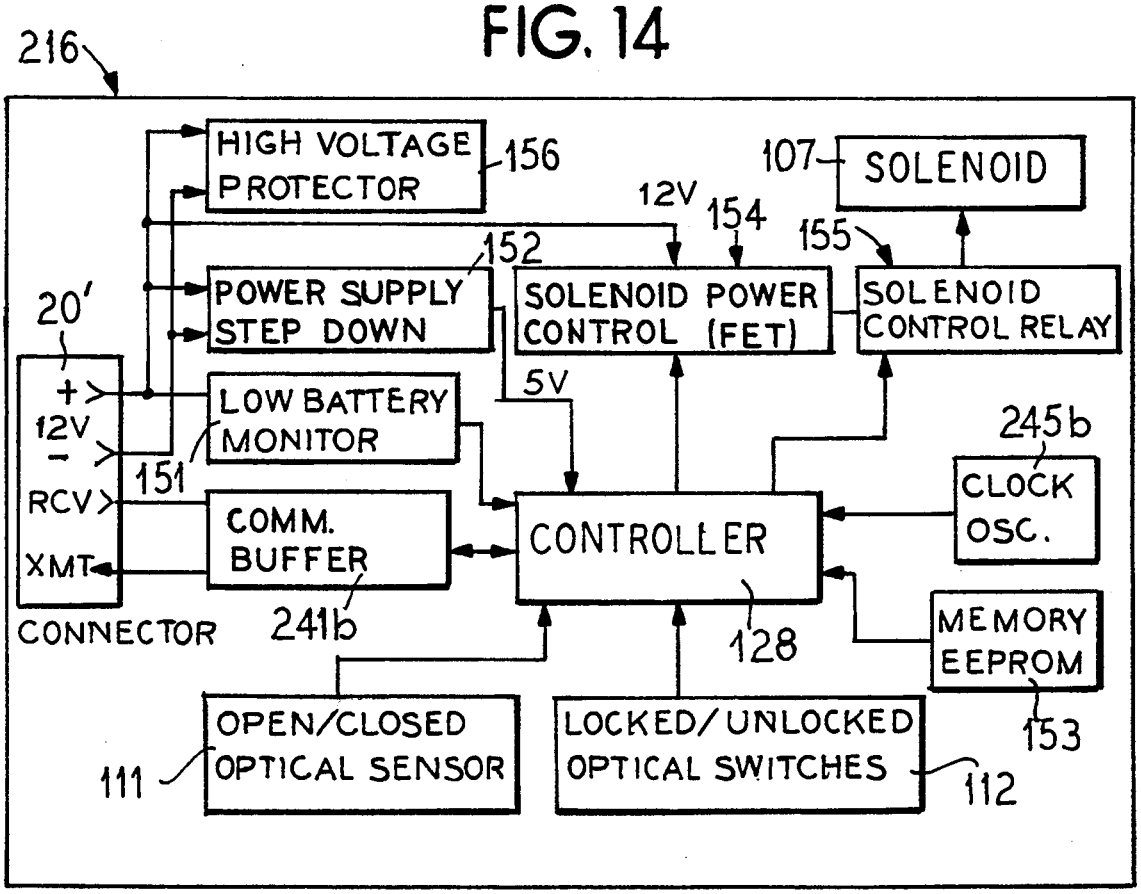
FIG. 14 is a diagram of the circuit components of the operating unit for the electronic lock of FIG. 11.

FIGS. 13 and 14 illustrate another preferred embodiment showing, in FIG. 13 an exterior accessible portion of the control unit and in FIG. 14 an interior portion of the control unit. By splitting the control unit between a door exterior portion containing essentially input and display functions as well as a power source, and an interior section which contains the control mechanism for actuating and de-actuating the locking system, a heightened level of security can be achieved since the lock controlling portion of the control is remote and inaccessible from the exterior of the enclosed chamber or compartment.

The exterior portion shown in FIG. 13 includes a keyboard or input device 238 which provides input to a controller member (microprocessor) 200. A clock oscillator 245*a* may be provided to time the functions of the control 200. A buzzer 243 may also be provided for producing an audible signal indicating actuation of the keyboard 238. Power is provided from a battery power pack 202 which in a preferred embodiment would be a 12 volt source. Because the controller may operate on a voltage other than 12 volts, in the preferred embodiment 5 volts, output from the battery pack 202 to the controller 200 is through a voltage step down supply 250. The controller 200 controls an LED or other visual display 240 which in turn may be powered through a current limiter or other signal control or processing device 247. Output from the controller 200 is also to a communication buffer 241*a* which ideally will be a combination encoder/decoder to communicate to the interior portion of FIG. 14 and to receive communications from the interior portion. A 4-wire connector shown at 20' receives output from buffer 241*a* and provides input to buffer 241*a* and also receives a 12 volt power from the battery pack.

As shown in FIG. 14 the interior portion 216 receives power and communications via the 4-wire connector 20'. The 12 volt power supply is directed to a high voltage protector 156 which upon sensing an abnormally high voltage, for example on the order of 18 volts or above, may cause a short to occur to protect the system from unauthorized tampering through the provision of unauthorized power or signal. The 12 volt power is also provided to a solenoid control 154 and to a voltage control 152 which similar to voltage control 250 may drop the 12 volt power to, for example, a 5 volt power for powering second controller 128. The power supply from the 4-wire connector 20' is also provided to a low battery monitor 151 which will sense decreasing power from the battery pack 202 and which can then provide a signal to controller 128 which signal can be used for various purposes such as, for example, temporary disabling the system and providing an output back through encoder/decoder communication buffer 241*b* to communication buffer 241*a* that is to the controller 200 to cause a display to appear at the display 240 indicating that the battery pack is to be replaced or recharged. Controller 128 is then used as the master controller to process information received from various input or output devices such as, for example, the keyboard 238, the optical sensor 111, the optical switches 112, the memory 153 and/or other sources. The memory 153 is preferably a non-volatile memory so as to maintain all control programming in the event of a loss of power including during replacement of the battery pack. Control of the solenoid is through the solenoid control relays 155 which pass power to the solenoid from the solenoid power control which in turn receives a direct 12 volt input. The solenoid power control, under direction from the controller 128 will first activate the appropriate one of the relays 155 to open a path to the selected input of the solenoid either to cause the lock to move from the open position to the locked position or from the locked position to the open position. After the appropriate path has been opened through the solenoid control relays then after an appropriate time delay, a solenoid activating power pulse will be sent from the power control through the relay to the solenoid to actuate movement of the look. In this manner, the electronic lock of this invention is highly power efficient since the solenoid is not a power receiving solenoid in its normal inactivated state but receives power only to change the state of the lock and then only for a short duration.

It can therefore be seen that the control unit section 218 of FIG. 13 is a operator input and display which can be externally positioned at an appropriate point and the portion 216 of FIG. 14 is internally positioned in a protected environment and controls operations of the bolt in accordance with program instructions contained in the memory 153 which memory may, as desired, be programmed with different input requirements such as access codes, combinations and the like.

It should be understood that various changes and modifications to the presently preferred embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

I claim:

1. A locking system for doors consisting of a door locking bolt unit installed on the inside and a control unit accessible from the outside of the door, the bolt unit comprising:

a casing enclosing a bolt displaceable between a projected, locking position wherein the bolt engages a receiving means and a withdrawn, unlocking position;

a solenoid device having an armature, the armature being displaceable between electromagnetically induced attracted and repelled positions; and linkage means coupled between the armature and the bolt to drive the bolt between the unlocking position and the locking position, respectively in dependent response to actuation of the armature wherein the linkage means provides a geometric multiplying effect to the locking position such that the bolt moves a greater distance than the armature, and locks the bolt in the locking position; and the control unit comprising:

an electric power source;

means for entering a pass-code;

means responsive to entering of the pass-code to actuate the solenoid device by a current pulse into the unlocking position of the bolt; and means for actuating the solenoid device by a reverse current pulse into the looking position of the bolt.

2. The system of claim 1 wherein the solenoid device comprises restraining means for impeding the movement of the armature when in the attracted position.

3. The system of claim 2 wherein the restraining means comprises a permanent magnet encompassing the armature.

4. The system of claim 1 wherein said linkage means comprises a lever arm pivoted at one end thereof to the bolt unit casing, at the other end thereof to the bolt, and at an intermediate point thereof to the armature.

5. The system of claim 4 wherein said lever arm is formed with a pair of slots constructionally associated with said intermediate point and said other end is pivotally connected such that the bolt becomes arrested in its locked position against forced displacement thereof in the unlocking direction.

6. The system of claim 5 further comprising:

a push-button electric switching device operatively associated with said lever arm for indicating one of the lever pivoted positions.

7. The system of claim 6 wherein said switching device consists of a micro-switch mounted to the bolt unit casing in juxtaposition to one end of the lever.

8. The system of claim 1 wherein said control unit comprises a scrolling keyboard.

9. The system of claim 8 wherein said scrolling keyboard is located on an upper surface of said control unit.

10. The system of claim 8 wherein said control unit is connected to said control unit by a four-cable connector providing power and communication therebetween.

11. The system of claim 1 wherein said control unit comprises a numerical keyboard.

12. The system of claim 11 wherein said numerical keyboard is located on an upper surface of said control unit.

13. The system of claim 1 wherein said control unit is connected to said bolt unit by a plait of wires, at least one of said wires including a plug and socket connector such that removal of said control unit causes separation of said connector.

14. The system of claim 1 further comprising:

an optical sensor located at the inside of said door and electrically coupled to the system such that the system is enabled when the door is closed and disabled when the door is opened.

15. The system of claim 1 wherein said optical sensor is installed on the bolt unit casing facing the frame head of the door.

16. The system of claim 1 wherein resetting means is provided to reset said pass-code.

17. The system of claim 16 wherein said resetting means comprises a micro-switch protectively mounted within said bolt unit casing and accessible by a key through a keyhole.

18. The system of claim 1 further comprising:

means for storing said pass-codes and audit trail data in said control unit.

19. The system of claim 1 further comprising:

means for storing said pass codes and programming in said bolt unit.

20. The system of claim 19 wherein said means for storing is an electrically erasable, programmable read-only memory.

21. A locking device for securing doors comprising:

a door edge looking bolt having a bolt projecting position and a bolt retracting position:;

a linkage assembly for actuating the bolt between the bolt projecting position and the bolt retracting position wherein the linkage assembly has a mechanical multiplying effect on the bolt, such that the bolt moves a greater distance than the plunger, and locks the bolt in the bolt projecting position;

a solenoid having a plunger for driving the linkage assembly in both directions between the bolt projecting position and the bolt retracting position;

a permanent magnet associated with the solenoid;

a ferrous member for attracting the plunger of the solenoid for maintaining the solenoid in a withdrawn position;

a spring for assisting in moving the plunger to a projected position wherein the ferrous member moves with the plunger; and a magnet having an attractive force to the ferrous member greater than force of the spring when the solenoid is in the withdrawn position.

22. The locking device of claim 21 further comprising:

a control unit responsive to entering of a pass-code resulting in actuation of the solenoid between the bolt projecting position and the bolt retracting position.

23. The locking device of claim 22 further comprising:

a keyboard for entering of the pass-code.

24. The locking device of claim 22 wherein the control unit is remotely located from the bolt.

* * * * *